US008702465B2

(12) United States Patent
Guthrie et al.

(10) Patent No.: US 8,702,465 B2
(45) Date of Patent: Apr. 22, 2014

(54) METHOD OF MANUFACTURING AN ELECTRODE-LESS INCANDESCENT BULB

(75) Inventors: Charles Guthrie, San Jose, CA (US); Edwin Charles Odell, Leicester (GB); Robin Devonshire, Sheffield (GB); Donald Wilson, San Jose, CA (US); Floyd Pothoven, Lakewood, CA (US)

(73) Assignee: Ceravision Limited, Milton Keynes (GB)

( * ) Notice: Subject to any disclaimer, the term of this patent is extended or adjusted under 35 U.S.C. 154(b) by 8 days.

(21) Appl. No.: 13/541,838

(22) Filed: Jul. 5, 2012

(65) Prior Publication Data

US 2013/0040529 A1 Feb. 14, 2013

Related U.S. Application Data

(63) Continuation-in-part of application No. 11/794,490, filed on May 7, 2008, now Pat. No. 8,241,082.

(51) Int. Cl.
*H01J 9/00* (2006.01)

(52) U.S. Cl.
USPC ..... 445/42; 445/43

(58) Field of Classification Search
USPC ..... 445/8, 26, 38, 42, 43, 53
See application file for complete search history.

(56) References Cited

U.S. PATENT DOCUMENTS

| | | | | |
|---|---|---|---|---|
| 3,421,804 | A * | 1/1969 | Taxil | 445/18 |
| 5,519,285 | A * | 5/1996 | Ukegawa et al. | 313/594 |
| 6,680,571 | B1 * | 1/2004 | Giorgi et al. | 313/565 |
| 2001/0000941 | A1 * | 5/2001 | Chandler et al. | 313/46 |

FOREIGN PATENT DOCUMENTS

| | | |
|---|---|---|
| EP | 0 788 140 | 9/2001 |
| JP | 42-27227/1967 | 12/1967 |
| JP | 02-094230 | 4/1990 |
| JP | 04-370646 | 12/1992 |
| JP | 06-013052 | 1/1994 |
| JP | 09-017393 | 1/1997 |
| JP | 9-213282 | 8/1997 |
| JP | 2000-076998 | 3/2000 |
| JP | 2001-023568 | 1/2001 |
| JP | 2004-014326 | 1/2004 |
| JP | 2004-281385 | 10/2004 |

* cited by examiner

*Primary Examiner* — Joseph L Williams
(74) *Attorney, Agent, or Firm* — Bay State IP, LLC

(57) ABSTRACT

The manufacture of an electrodeless bulb involves one end of a tube closed off, and a first neck is formed in the tube close to the closed end. A second neck is formed in the tube, close to the still open end; a metal halide pellet of known size is dropped into the tube and the tube is evacuated. With the vacuum being maintained heat is applied to the closed end, causing the metal halide pellet to sublime and with it the impurities. The impurities are drawn off, the vacuum being maintained and the metal halide condenses in the tube between the necks. Once the tube is cool, the evacuation is discontinued and the tube is refilled with noble gas and the quartz tube is sealed off at the second neck.

12 Claims, 6 Drawing Sheets

METHOD OF MANUFACTURING AN ELECTRODE-LESS INCANDESCENT BULB

CROSS-REFERENCE TO RELATED APPLICATIONS

This application is a Continuation-in-part application, which takes the benefit of and claims priority from U.S. application Ser. No. 11/794,490 filed on May 7, 2008, now U.S. Pat. No. 8,241,082, the contents of which are hereby incorporated by reference.

BACKGROUND OF THE INVENTION

1. Field of the Invention

The present invention relates to an electrodeless incandescent bulb.

2. Description of the Related Art

Electric lamps generally comprise either an incandescent ohmic filament bulb and suitable fittings or a discharge bulb usually with electrodes for exciting the discharge. The resultant radiation is not always visible, in which case, the bulb is lined with phosphorescent material to provide visible light. It is known also to provide a bulb without electrodes and to excite it by applying external radiation, in particular microwave energy.

An electrodeless lamp using a microwave source is described in U.S. Pat. No. 6,737,809, in the name of F M Espiau et al., the abstract of which is as follows:

A dielectric waveguide integrated plasma lamp with a body consisting essentially of at least one dielectric material having a dielectric constant greater than approximately 2, and having a shape and dimensions such that the body resonates in at least one resonant mode when microwave energy of an appropriate frequency is coupled into the body. A bulb positioned in a cavity within the body contains a gas-fill which when receiving energy from the resonating body forms a light-emitting plasma.

Despite reference to a "bulb", this specification does not describe a discrete bulb, separable from the lamp body.

In our earlier International Patent Application, published under No WO 02/47102, we described:

A lamp has a body of sintered alumina ceramic material and an artificial sapphire window. The body is initially moulded in green state and the window is pressed into a front recess. The combination is fired at a temperature of the order of 1500° C., to fuse the body into a coherent pressure-tight state with the window. After partial cooling to the order of 600° C., a pellet of excitable material is added through a rear, charging aperture. A disc of ceramic with frit is placed over the aperture. The disc is irradiated by laser to fuse the frit and the disc to the body, thus sealing the excitable material into the lamp.

SUMMARY OF THE INVENTION

The object of the present invention is to provide an improved method of making an electrodeless incandescent bulb.

According to the invention there is provided a method of making an electrodeless incandescent bulb, the method comprising the steps of:

- providing a bulb enclosure of quartz glass,
- forming an adjacent neck having a bore less than a transverse internal dimension of the bulb enclosure either:
  - integrally with the bulb enclosure in a tube integral therewith or
  - in a branch tube opening into the bulb enclosure,
- forming a further neck remote from the adjacent neck, either in
  - the integral tube or
  - in the branch tube;
- preparing the bulb for sealing by performing the following steps in direct sequence:
  - inserting at least one pellet of excitable material, either
    - in the integral tube or the branch tube between the further neck and the adjacent neck or
    - all the way into the bulb enclosure through the adjacent neck,
  - evacuating the bulb enclosure via the integral tube or the branch tube;
  - heating, either:
    - the integral tube or the branch tube where the or each pellet is between the further neck and the adjacent neck or
    - the bulb enclosure where the or each pellet is in it
  - to drive off volatile impurity from the excitable material, the impurity being evacuated;
  - allowing the excitable material to condense, either:
    - in the integral tube or the branch tube on the further neck side of the adjacent neck or
    - in the bulb enclosure and
  - filling the bulb tube with inert gas, after evacuation and prior to sealing;
- preliminarily sealing the bulb at the further neck; and
- finally sealing the bulb at the adjacent neck.

Preferably:

- the bulb enclosure is cooled during the preliminary sealing, whereby the excitable material is allowed to condense in the bulb enclosure during the preliminary sealing;
- the bulb enclosure is cooled by blowing air at or liquefied gas its outer surface;
- the bulb enclosure is cooled during the final sealing, whereby the excitable material is allowed to condense in the bulb enclosure during the final sealing;
- the bulb enclosure is cooled by blowing air or liquefied gas at its outer surface.

Further the method preferably includes the steps of:

- heating the tube or the branch tube between the preliminary sealing and the final sealing and
- allowing the excitable material to re-condense in the bulb enclosure prior to the final sealing.

We have found that advantageous effects can be obtained by use of a mix of excitable elements. Accordingly, the pellet insertion step may include insertion of more than one pellet.

Whilst other shapes such as spherical can be envisaged, preferably, the enclosure is a tube and the method includes the step of closing off at least one opening in the bulb tube and wherein the step of forming the adjacent neck includes:

- formation of the neck remote from the closed end in the case of the adjacent neck being formed integrally in the bulb or
- closing off the other end of the bulb enclosure end in the case of the adjacent neck being formed in a branch tube.

Preferably, the adjacent neck is formed and positioned with respect to the central axis of the bulb tube such that with the bulb tube, or the other tube, horizontal the pellet would have to roll upwards in order to enter the bore of the adjacent neck. The arrangement is such that the pellet can pass through the neck and yet can be restrained from rolling along the tube by the neck and retained remote from the other end of the tube during sealing.

Normally, the central axis of the adjacent neck will be co-incident, at least at an intersection point, with the central axis of the bulb tube.

Preferably:

the bulb is sealed at the adjacent neck;

the bulb tube, or the other tube where provided, is formed with a further neck remote from the adjacent neck, and the bulb tube, or the other tube, is preliminarily sealed at the further neck, prior to final sealing of the bulb at the adjacent neck.

Where two necks are provided, the first seal can be made at the outer neck, with a second seal being made subsequently at the inner neck, the portion of the tube between the necks being broken off and discarded.

In certain embodiments, the one end of the bulb tube is sealed by closure of the bulb tube with its own material. This end can be ground flat or ground to form a lens. Similarly, the other end can be sealed with the tube's own material and ground flat or to lens shape.

In other embodiments, the one end of the bulb tube is sealed by fusion of an additional piece to the end of the bulb tube. The additional piece can be flat circularly curved—preferably on both surfaces—or lens shaped. Where the branch tube is provided, the other end similarly can be sealed by fusion on of a flat or other shaped additional piece.

In other embodiments again, the bulb may be integrally form by blowing, and attached to a tube at a neck.

Normally the method will include:

an additional step of filling the bulb tube with inert gas, preferably a noble gas, after evacuation and prior to sealing.

Whilst providing an appreciable length of tube between the adjacent neck and the further neck enables the amount of gas being sealed into the bulb to be predicted; where the gas has a high enough boiling point, such as krypton, it may be condensed at the end of the bulb tube remote from the seal being effected at the adjacent neck by application of liquid nitrogen to the remote end of the bulb.

Further the method can include:

a preliminary step of precision boring the bulb tube; and a preliminary step of centrelessly grinding and polishing the bulb tube.

However, in certain embodiments, precision drawn quartz tube can be used.

Preferably:

the excitable material is metal halide material;

the pellet or pellets of excitable material is of a size to provide an excess of the material when vaporised to form a saturated atmosphere of the material in the bulb; and the method includes the formation of a slight convexity without appreciable concavity inside the seal at the adjacent neck, to avoid both the formation of a spigot liable to overheat or a recess liable to form a cold spot away from the plasma such as to cause the bulk of the excitable material to condense there in use.

According to another aspect of the invention, there is provided an electrodeless incandescent bulb made in accordance with the method of the first aspect.

BRIEF DESCRIPTION OF THE DRAWINGS

To help understanding of the invention, specific embodiments thereof will now be described by way of example and with reference to the accompanying drawings, in which.

DETAILED DESCRIPTION OF THE PREFERRED EMBODIMENT

Figure 1:
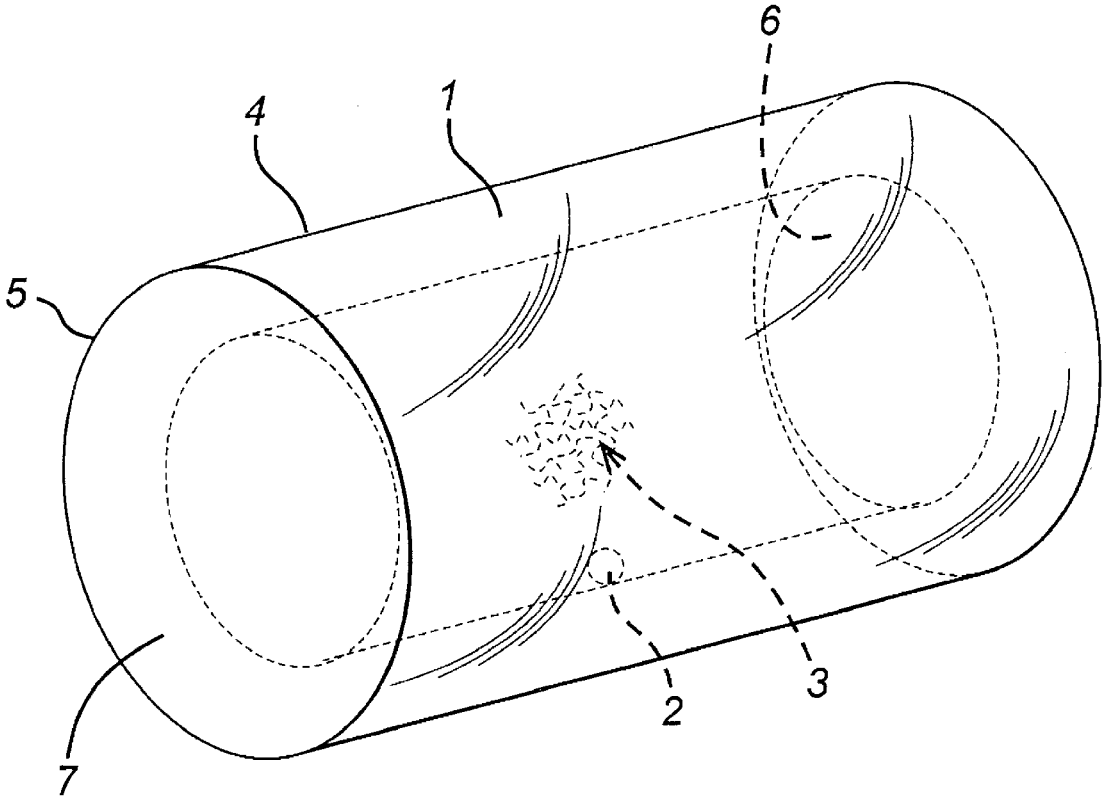
FIG. 1 is a perspective view of a bulb according to the invention.

Referring to the drawings, the bulb shown in FIG. 1 has a wall 1 of quartz and a fill of metal halide material 2—initially in pellet form—and noble gas 3, typically neon, argon, xenon or krypton. The wall is cylindrical along its length 4, with transverse ends 5. These are formed with flat inside surfaces 6 and flat outside surfaces 7. The former surfaces are made by heating and manipulating their material in a glass lathe in a known manner and the latter surfaces by grinding and polishing, also in a known manner. The bulb is formed in its length of precision bore and centrelessly ground and polished material, whereby the bulb is of a volume pre-determined by its external dimensions. Typically these are 12 mm long by 6 mm diameter.

Figure 2:
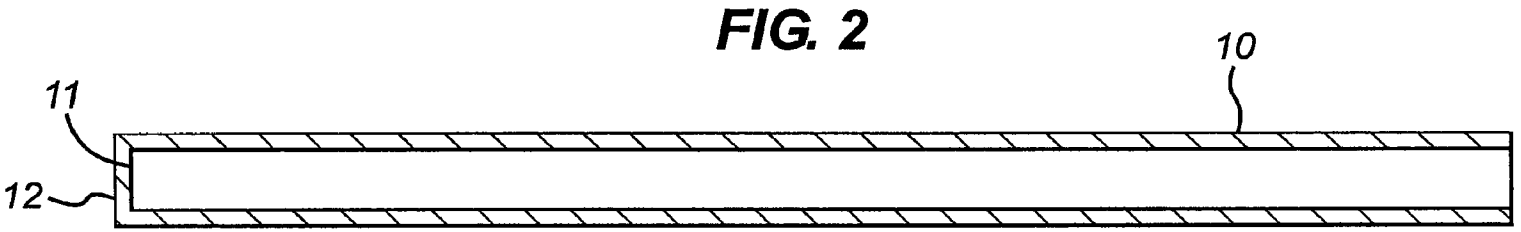
FIG. 2 is a diagrammatic side view of a piece of quartz tube, sealed at one end in preparation for production of the bulb of FIG. 1.
Figure 3:
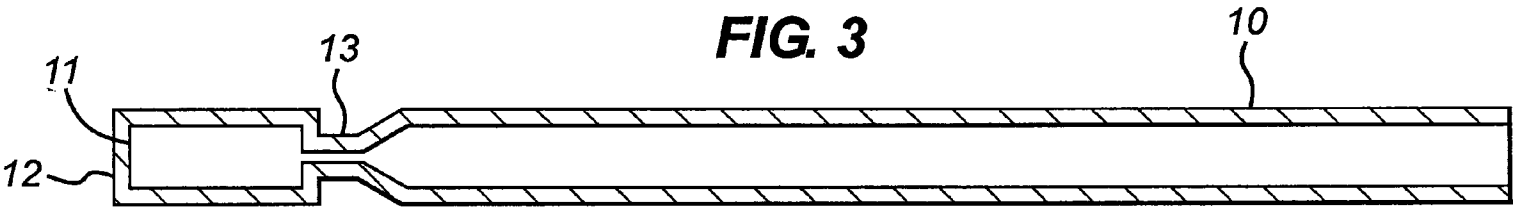
FIG. 3 is similar view of the quartz tube with a first neck formed preliminary to sealing.
Figure 4:
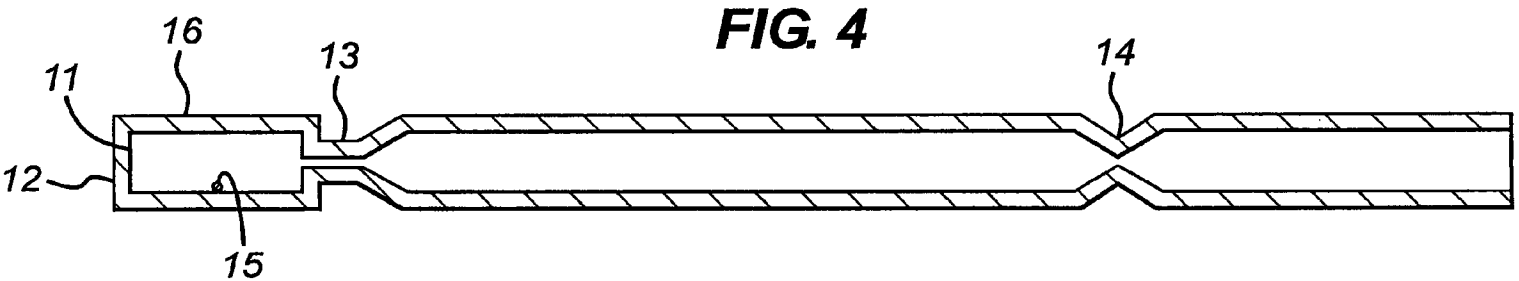
FIG. 4 is a similar view of the tube with two necks formed, preliminary to sealing.
Figure 5:
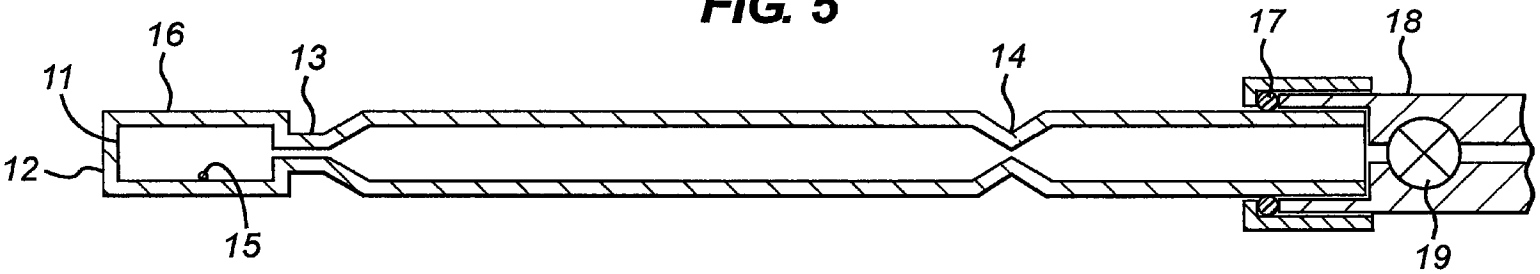
FIG. 5 is a further view of the tube with an evacuation fitting connected to its open end.
Figure 6:
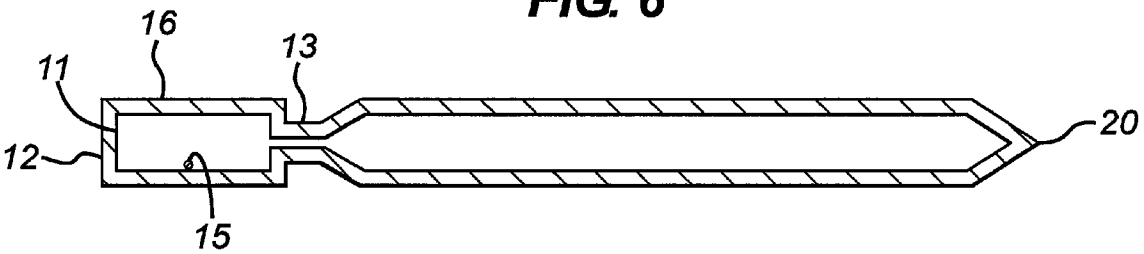
FIG. 6 is a diagrammatic side view of the tube after a first seal.
Figure 8:
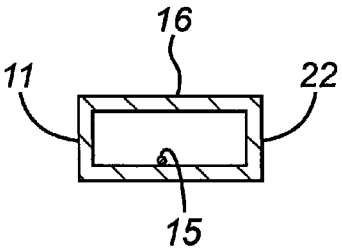
FIG. 8 is a similar view of the finished bulb.

Turning on to FIGS. 2 to 6, the bulb is formed from a length 10 of quartz tube, which starts approximately ten times its finished length. Typically, the 6 mm outside diameter tube has a 4 mm inside diameter. The steps in the manufacture of the bulb are as follows:

1. One end 11 is closed off and made flat 12, as shown in FIG. 2, in a glass lathe not shown.
2. A first neck 13 is formed in the tube close to the closed end, as shown in FIG. 3. This neck is positioned and formed to facilitate finishing the bulb to length.
3. A second neck 14 is formed in the tube, close to the still open end, as shown in FIG. 4, the first neck having been formed close to the closed end. The tube is removed from the lathe.
4. A metal halide pellet 15 of known size is dropped into the tube and rolled & tapped past the two necks 13,14. With the pellet in the portion 16 ending with the closed end 11, the tube is evacuated. This is effected with an O-ring 17 fitted on the precision ground outer surface of the tube. The O-ring is captivated in a fitting 18 having a valve 19 through which the tube can be evacuated.
5. With the vacuum being maintained heat is applied to the closed end 11, causing the metal halide pellet to sublime and release gaseous impurities. The impurities are drawn off, the vacuum being maintained. The metal halide condenses in the tube between the necks. The tube can be kept cool in this region by directing cooling air onto it.

6. The evacuation is continued until the tube has cooled down where heated for sublimation. Once it has cooled, the evacuation is discontinued and the tube is refilled with noble gas, see FIG. 5.
7. The valve in the fitting 17 is closed and the fitting is supported in the tail stock of the lathe. Conveniently, the necks are formed in one lathe and the filling and sealing is performed in another lathe.
8. The quartz tube is sealed off at the second neck 14 before the fitting 18 is removed.
9. Once the tube is sealed off, the metal halide and the noble gas is captivated in the tube. The fitting 18 is removed. The act of heating for sealing the second neck 14 will have begun to cause—or indeed completely caused—the condensed sublimate to re-sublime and re-condense further towards and/or in the closed end. This end can be cooled to encourage re-condensation here, in the manner shown in FIG. 9 (which illustrates the next sealing stage). If necessary, further heat can be applied intermediate the necks. The balance of the tube can be removed beyond the first formed seal. The result is that with the pellet 15 having been sublimed from and back into the first-closed-end side of the first neck 13, the sealing 20 is able to be effected at the second neck
   9.1. without the impurities being sealed in;
   9.2. without the metal halide vaporising and
   9.3. without the greater part of the noble gas fill not being heated.

Figure 7:
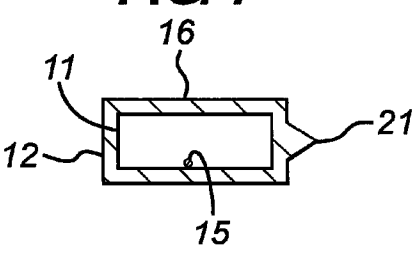
FIG. 7 is a similar view of the tube after a second seal.
Figure 9:
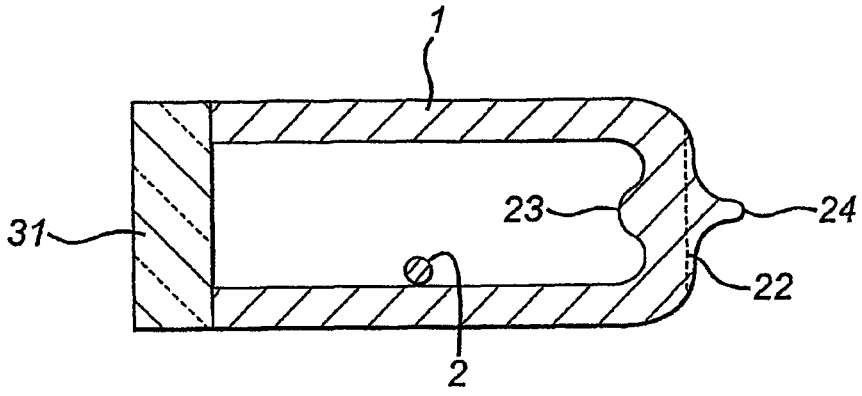
FIG. 9 is a diagrammatic view of a bulb being sealed in accordance with the invention in a glass lathe.

Thus the contents of the tube are well defined.
10. Next, the first neck 13 is sealed off at 21 as shown in FIG. 9.
11. The sacrificial piece of tube between the seals is removed and the tube is worked to form the seal to the shape shown in FIG. 7. Should final sizing of the bulb result in the metal halide material vaporising during this operation, it is contained within a tube of known dimensions, whereby the amount coming to be trapped in the portion 16 is known. Whether it vaporises or not—as is preferred—under the final sealing conditions, the original quantity of metal halide ends in the portion 16.
12. The final step—not separately shown—is the polishing of the sealed and broken off end 19 to a smooth end 22.

Referring to FIG. 9, the right had end of the bulb thereshown is formed essentially as just described, but the left hand end is differently formed. The right hand end has a small internal convexity 23, formed during inwards manipulation of the glass to ensure a good seal, and an external spike 24 formed by drawing of the unwanted portion of the tube away from the formed bulb. The external spike is ground off to the flat end 22. The internal convexity is provided to ensure that there is no concavity, which could cause the excitable material to condense in use away from the plasma to such extent that a small amount of the material only is vaporised, resulting in poor light output. However, where the external spike 24 acts as a heat sink, it can cause the convexity 23 inside it to function as a cold spot for such condensation, being at the end of the bulb with heat being coupled into the body of the metal halide/noble gas contents centrally of the bulb. In practice, the metal halide pellet is sized such that there is an excess of the material in the bulb, i.e. there is more than enough for the quantity required for a saturated vapour atmosphere of material in the bulb in operation. The balance accumulates on the cold spot 23, as the preferential condensation point, with the material evaporating from hotter points elsewhere in the bulb.

The left hand end of the tube is formed from a flat disc 31 of quartz glass, fused onto the tube. The flat disc enables light leaving the bulb to do so in a straight a line from the plasma formed centrally of the bulb in operation.

Figure 10:
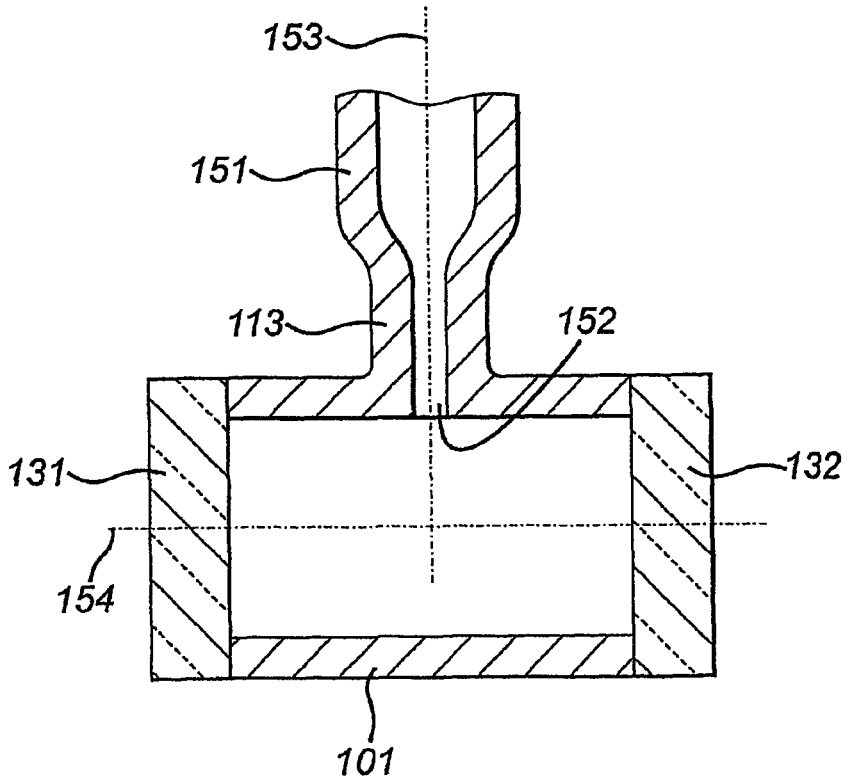
FIG. 10 is a large scale view of a variant of the bulb of FIG. 8.
Figure 11:
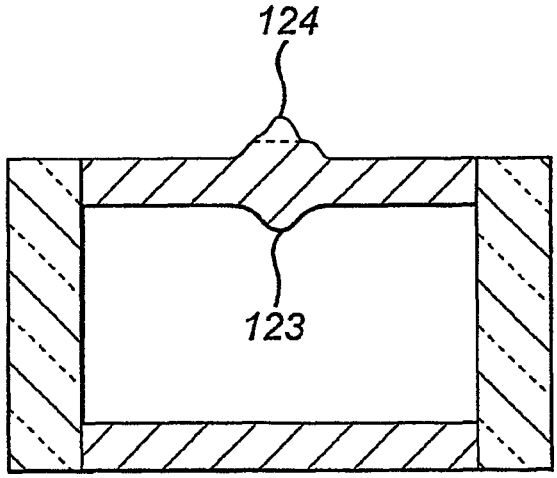
FIG. 11 is a view on the same scale as FIG. 10 of a partially formed bulb of the invention with a side branch.

FIGS. 10 and 11 show a second bulb, which is formed from a main bulb tube 101 and a slightly smaller diameter branch tube 151. The main tube is cut to length and has fused-on, flat disc ends 131,132. The branch tube has a first neck 113 and a second neck similar to the neck 14 in an extension of the tube not shown in FIG. 10. The neck 113 is at the junction of the bulb tube and the branch tube. An aperture 152 is provided in the wall of the bulb tube, for introduction of the metal halide pellet, evacuation, expulsion of impurity and introduction of the noble gas. As with the in-line bulb tube and excess tube of the first bulb, with the axis 153 of the branch tube being truly radial from the axis 154 of the bulb tube, once the pellet has been introduced into the bulb tube via the branch tube and the aperture 152, it can be heated for sublimation either to the other end of the bulb tube or out of the bulb tube into the branch tube. The sublimation is accompanied by impurity evacuation. The condensed sublimate is returned to the bulb tube in like manner to that of the embodiment of FIGS. 1 to 9.

As shown in FIG. 11, sealing of the bulb at the neck 113 results in an internal convexity 123 and an external spike 124, which can be ground off.

Figure 12:
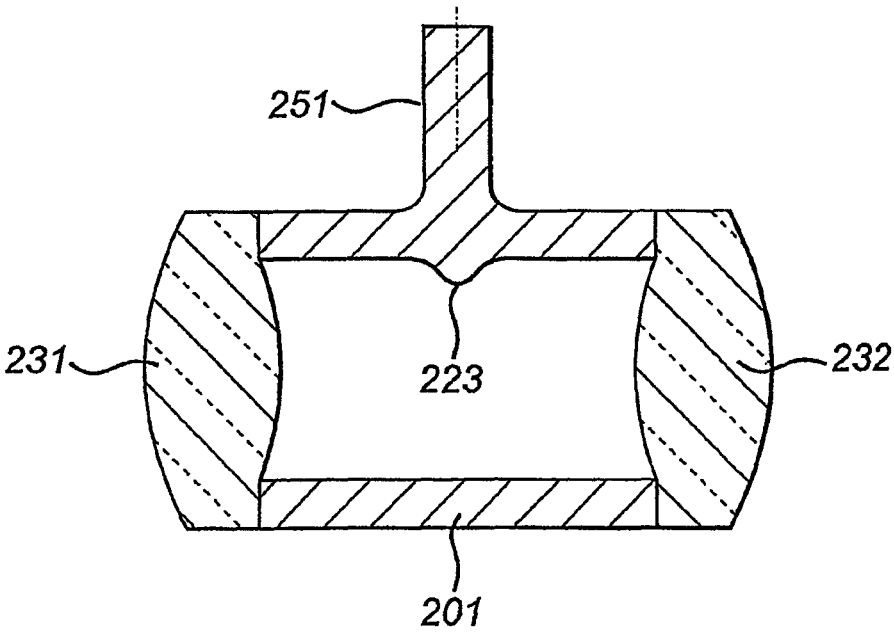
FIG. 12 is a similar view of the bulb of FIG. 11, fully formed.
Figure 13:
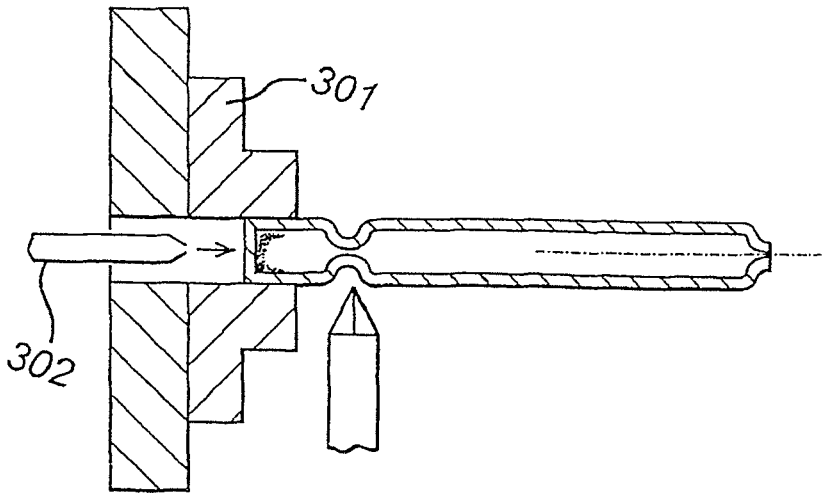
FIG. 13 is a similar view of a third bulb of the invention.

The third bulb shown in FIG. 12 has a bulb tube 201 and a vestigial branch tube or arm 251. The ends 231,232 of the bulb are lens shaped, having been formed to shape prior to fusing to the end of the tube 201. This is of advantage, over the flat ends of the bulb of FIG. 10, where it is advantageous to bring light from the bulb to a focus; whereas flat end bulbs are advantageous where collimated light is required.

The bulb 201 has a convexity 223 similar to the convexity 123. The vestigial branch tube arm 251 is formed in the process of sealing the branch tube. It is aligned with the convexity and adjacent to it. In use, the arm is accommodated in a ceramic wave-guide, which runs colder than the bulb. As such the arm provides a heat conduction path from the bulb and maintains the convexity colder than the rest of the bulb, whereby it can act as a condensation cold spot.

Figure 14:
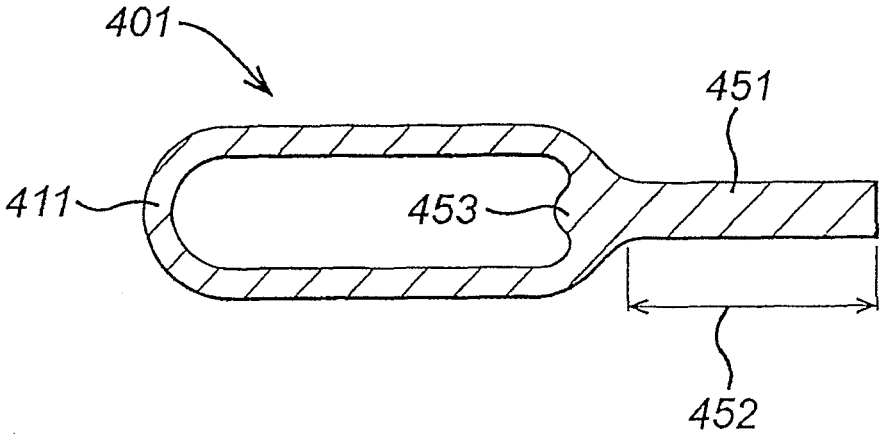
FIG. 14 is view of another bulb formed in accordance with the invention.

Referring now to FIG. 14, the bulb 401 shown there has an extension 451, which is formed by working down the residual piece of tube, and breaking this off at the desired distance 452 from the seal 453. The extension can form a convenient means for securing the bulb in use. Alternatively to working down the residual tube a piece of rod can be fused on at the seal. This bulb has a hemispherical end 411, for allowing light to pass normally through the bulb wall. This is advantageous where the incandescent plasma has a similar shaped end. Such as end can be formed either by fusing on an initially separate piece, by glass lathe work or indeed by blowing.

The invention is not intended to be restricted to the details of the above-described embodiments. For instance, alternative incandescent discharge materials that can be used are sulphur, the halides of mercury, sodium and potassium. Again, whilst a tubular bulb, with a single concavity and a single arm, where these are provided, is presently preferred; a spherical bulb with a three arms and hot spots for instance can be envisaged.

A further possibility is that the bulb being sealed should be cooled with liquid nitrogen, to condense the noble gas fill contained with the bulb tube and the extension tube into the bulb to be formed during the sealing of the bulb. This can be effected by providing a nozzle 301 behind the chuck 302 holding the bulb and releasing a jet of liquid nitrogen from a nozzle onto the end of the bulb tube, as shown in FIG. 9.

Again, it is not essential for the metal halide to be introduced first into the bulb tube; it can be introduced into the sacrificial tube between the two necks. Thence, it can be moved by sublimation and by cooling of the bulb tube and re-condensation of the metal halide in the bulb tube. The impurity is evacuated as in the above embodiments.

What is claimed is:

1. A method of making an electrodeless incandescent bulb, the method comprising the steps of:

providing a bulb enclosure of quartz glass;

forming an adjacent neck having a bore less than a transverse internal dimension of the bulb enclosure either:

integrally with the bulb enclosure in a tube integral therewith or in a branch tube opening into the bulb enclosure;

forming a further neck remote from the adjacent neck, either in the integral tube or the branch tube;

preparing the bulb for sealing by performing the following steps in direct sequence:

inserting at least one pellet of excitable material, either in the integral tube or the branch tube between the further neck and the adjacent neck or all the way into the bulb enclosure through the adjacent neck, evacuating the bulb enclosure via the integral tube or the branch tube, heating, either:

the integral tube or the branch tube where the or each pellet is between the further neck and the adjacent neck or the bulb enclosure where the or each pellet is in it to drive off volatile impurity from the excitable material, the impurity being evacuated and allowing the excitable material to condense, either:

in the integral tube or the branch tube on the further neck side of the adjacent neck or in the bulb enclosure and filling the bulb tube with inert gas, after evacuation and prior to sealing;

preliminarily sealing the bulb at the further neck; and finally sealing the bulb at the adjacent neck.

2. A method according to claim 1, wherein the bulb enclosure is cooled during the preliminary sealing, whereby the excitable material is allowed to condense in the bulb enclosure during the preliminary sealing.

3. A method according to claim 2, wherein the bulb enclosure is cooled by blowing air or liquefied gas at its outer surface.

4. A method according to claim 1, wherein bulb enclosure is cooled during the final sealing, whereby the excitable material is allowed to condense in the bulb enclosure during the final sealing.

5. A method according to claim 4, wherein bulb enclosure is cooled by blowing air or liquefied gas at its outer surface.

6. A method according to claim 1, including the steps of:

heating the integral tube or the branch tube between the preliminary sealing and the final sealing and allowing the excitable material to re-condense in the bulb enclosure prior to the final sealing.

7. A method according to claim 1, wherein the inert gas is a noble gas.

8. A method according to claim 1, wherein the enclosure is a tube.

9. A method according to claim 8, including a step of blowing the enclosure including a closed end of the bulb tube, the closed end being flat or hemispherical and wherein the step of forming the adjacent neck includes:

formation of the neck remote from the closed end in the case of the adjacent neck being formed integrally in the bulb or closing off the other end of the bulb enclosure end in the case of the adjacent neck being formed in a branch tube.

10. A method according to claim 8, including a step of closing off at least one opening in the bulb tube preliminarily to sealing off the bulb and wherein the step of forming the adjacent neck includes:

formation of the neck remote from the closed end in the case of the adjacent neck being formed integrally in the bulb or closing off the other end of the bulb enclosure end in the case of the adjacent neck being formed in a branch tube.

11. A method according to claim 1, wherein an another end of the bulb tube is sealed by closure of the bulb tube with its own material.

12. A method according to claim 11, wherein the another end of the bulb tube is ground to form a lens.

* * * * *